US009685285B2

(12) United States Patent
Barile et al.

(10) Patent No.: US 9,685,285 B2
(45) Date of Patent: Jun. 20, 2017

(54) SINGLE ACTUATOR CONTROL SWITCH

(71) Applicant: BITRON S.P.A., Turin (IT)

(72) Inventors: Marco Barile, Rossana (IT); Michelangelo Bono, Rossana (IT)

(73) Assignee: BITRON SPA, Turin (IT)

( * ) Notice: Subject to any disclaimer, the term of this patent is extended or adjusted under 35 U.S.C. 154(b) by 0 days.

(21) Appl. No.: 14/772,692

(22) PCT Filed: Mar. 3, 2014

(86) PCT No.: PCT/IB2014/059398
§ 371 (c)(1),
(2) Date: Sep. 3, 2015

(87) PCT Pub. No.: WO2014/136034
PCT Pub. Date: Sep. 12, 2014

(65) Prior Publication Data

US 2016/0035515 A1 Feb. 4, 2016

(30) Foreign Application Priority Data

Mar. 6, 2013 (IT) ..... TO2013A0179
Mar. 6, 2013 (IT) ..... TO2013A0180

(51) Int. Cl.
*H01H 9/26* (2006.01)
*H01H 13/72* (2006.01)
(Continued)

(52) U.S. Cl.
CPC ..... *H01H 13/7006* (2013.01); *H01H 13/04* (2013.01); *H01H 23/168* (2013.01); *H01H 23/205* (2013.01); *H01H 2205/002* (2013.01)

(58) Field of Classification Search
CPC ..... H01H 13/60; H01H 13/72; H01H 13/76; H01H 23/16; H01H 23/24; H01H 23/26;
(Continued)

(56) References Cited

U.S. PATENT DOCUMENTS 4,215,257 A 7/1980 Repplinger
4,697,053 A 9/1987 Lockard
5,107,082 A * 4/1992 Valenzona ..... H01H 23/025 200/292

FOREIGN PATENT DOCUMENTS

DE 10254992 A1 6/2004
EP 2468590 A1 6/2012
WO WO 99/05691 A1 2/1999

OTHER PUBLICATIONS

International Search Report for corresponding International Application No. PCT/IB2014/059398 mailed May 26, 2014.
(Continued)

*Primary Examiner* — Anthony R. Jimenez
(74) *Attorney, Agent, or Firm* — Merchant & Gould P.C.

(57) ABSTRACT

A control switch includes a key, a housing structure, in the upper portion of which the key is secured in a manner such that the key can rotate about a first fulcrum. A tip is secured at one end to the key and moving integrally therewith, so as to slide along a first axis (X) of the key is countered by an elastic element. A printed circuit board includes at least two push-buttons, arranged in the lower portion of the housing structure. The housing structure includes in its internal portion, a flared structure having two inclined contact planes specularly opposite with respect to a second vertical axis (Z) and forming a first obtuse angle (a), on which the tip can slide along its stroke. The flared structure is structurally secured to the housing structure. The switch includes at least one actuator positioned in proximity to the flared structure.

5 Claims, 13 Drawing Sheets

(51) Int. Cl.

| | |
|---|---|
| ***H01H 13/76*** | (2006.01) |
| ***H01H 13/70*** | (2006.01) |
| ***H01H 23/16*** | (2006.01) |
| ***H01H 23/20*** | (2006.01) |
| ***H01H 13/04*** | (2006.01) |

(58) Field of Classification Search

CPC ..... H01H 23/06; H01H 23/00; H01H 23/12; H01H 23/162; H01H 23/20; H01H 21/00; H01H 21/02; H01H 21/18; H01H 21/36; H01H 21/40; H01H 21/42; H01H 21/04; H01H 9/26; H01H 13/7006; H01H 13/04; H01H 23/168; H01H 23/205; H01H 21/48; H01H 21/54; H01H 2205/002

USPC ..... 200/5 A, 329, 336, 339, 529, 538, 200/557–559, 553, 401, 409, 457, 459, 4, 200/6 R, 537, 277.2, 315, 402, 406, 513

See application file for complete search history.

(56) References Cited

OTHER PUBLICATIONS

International Preliminary Report for Patentability for corresponding International Application No. PCT/IB2014/059398 mailed Feb. 11, 2015.

* cited by examiner

SINGLE ACTUATOR CONTROL SWITCH

This application is a National Stage Application of International Application No. PCT/IB2014/059398, filed 3 Mar. 2014, which claims benefit of Serial No. TO2013A000179, filed 6 Mar. 2013 in Italy, and also claims benefit of Serial No. TO2013A000180, filed 6 Mar. 2013 in Italy, and which applications are incorporated herein by reference. To the extent appropriate, a claim of priority is made to each of the above disclosed applications.

BACKGROUND OF THE INVENTION

The present invention relates to a control switch comprising a mechanism for the actuation of push-buttons, preferably comprising electronic contacts and silicone domes.

In the switch according to the present invention, the switching of the push-button occurs in a substantially instantaneous manner when the key reaches a predetermined angle of inclination.

Switches are known from patent application EP2468590 which comprise actuation mechanisms for contacts comprising silicone domes, wherein an actuation tip associated with a key is adapted to slide on an inclined plane, and wherein the tip, along its stroke on the inclined plane, acts upon an actuating element which, as it rotates about a fixed fulcrum axis, e.g. comprised in the structure on which the inclined plane is formed, is adapted to act upon a silicone dome. The action exerted by the actuating element on the dome causes the latter's structure to collapse, thus closing an electric contact.

Although this solution appears to be simple, difficulties arise when trying to ensure an adequate level of activation/deactivation reliability in all components of said switch.

The main difficulties are the limited stroke of such horizontally-pivoted keys, which is due to both aesthetical and ergonomical reasons, and which often cannot ensure a proper switching of the contacts.

Moreover, the latest structural specifications require shorter distances between the centres of the contacts, e.g. the distance between the silicone domes. This translates into a force/displacement graph showing a sudden force decrease at a predetermined time instant. The switching of the push-button occurs right at that instant of abrupt force drop.

This implies that, given the reduced distance between the silicone domes and the fixed fulcrum point, it is necessary to generate a very wide angle in order to obtain a stroke sufficient to ensure the electric switching. Such a wide angle cannot ensure the proper actuation of the dome, which should occur as vertically as possible.

SUMMARY OF THE INVENTION

The present invention proposes to solve the abovementioned problems by providing a control switch comprising an actuation mechanism.

Auxiliary features of the present invention are also set out herein.

BRIEF DESCRIPTION OF THE DRAWINGS

The features and advantages of said switch will become apparent from the following description of one embodiment thereof referring to the annexed drawings, which specifically illustrate the following:

FIG. 4A shows the switch in the idle operating configuration; FIG. 4B shows the switch during the transition between the idle operating configuration and the pull operating configuration; FIG. 4C shows the switch in the pull operating configuration;

FIG. 5A shows the switch during a first transition before reaching the pull operating configuration; FIG. 5B shows the switch during a second transition before reaching the pull operating configuration; FIG. 5C shows the switch in the pull configuration; FIG. 5D shows the switch during a further stroke of the key after switching has occurred;

FIG. 7A is a bottom sectional view of the switch relative to a plane lower than the section plane used in FIG. 3; FIG. 7B is a vertical sectional view of the switch of FIG. 7A; FIG. 7C shows a detail of the tip, of the flared structure and of the contact portions in a first embodiment; FIG. 7D shows a detail of the tip, of the flared structure and of the contact portions in a second embodiment.

DETAILED DESCRIPTION OF THE PREFERRED EMBODIMENT(S)

Figure 1:
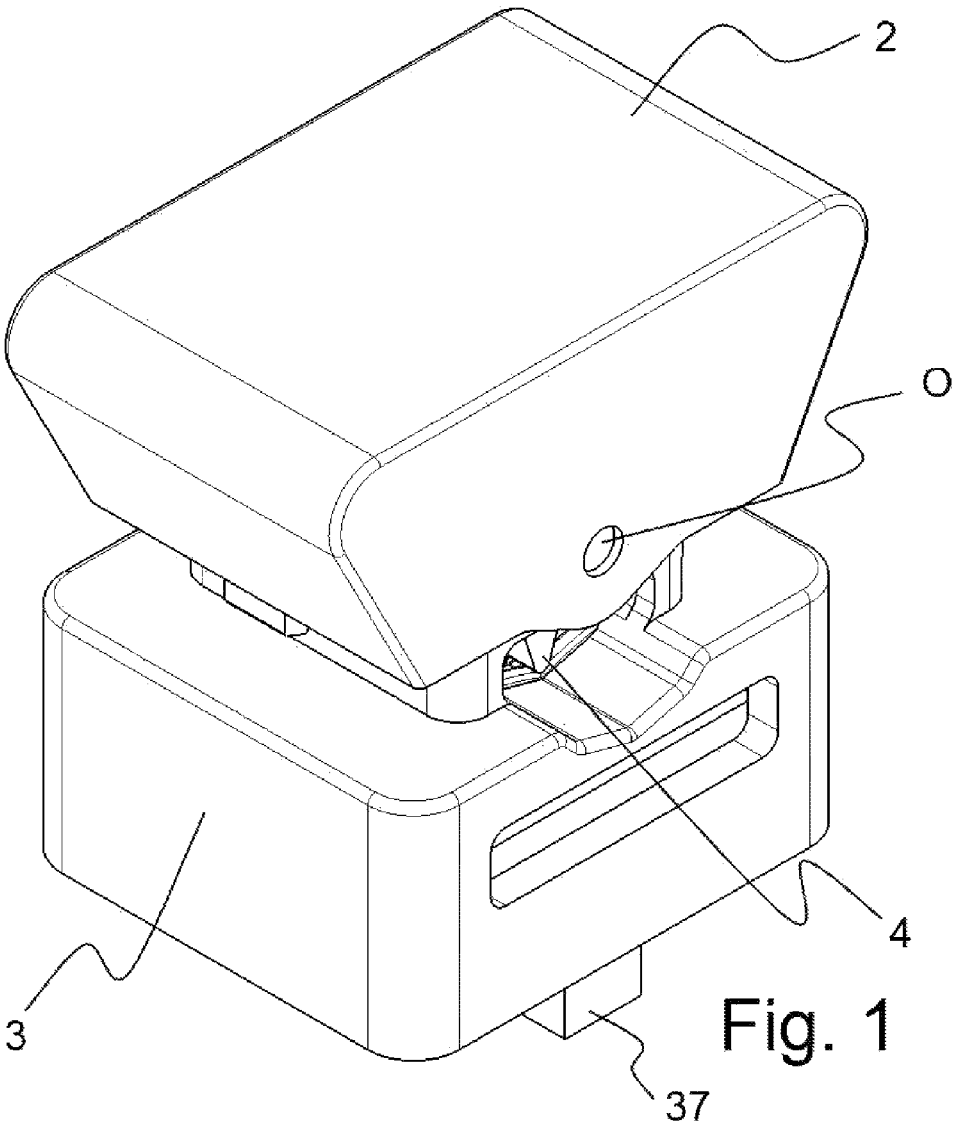
FIG. 1 is an axonometric view of a switch, with the associated actuation mechanism, according to the present invention.
Figure 2:
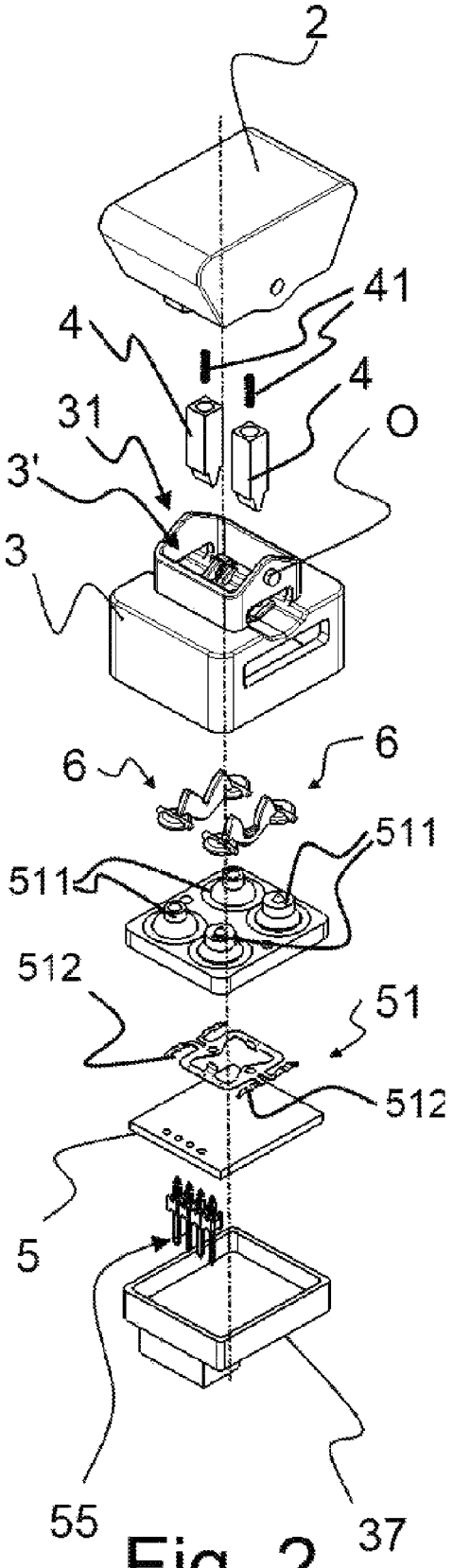
FIG. 2 is an exploded view of the switch of FIG. 1.

With reference to the above-listed drawings, the control switch comprises a key 2, e.g. horizontally pivoted, through which the user can operate the switch, a housing structure 3, in the upper portion of which said key 2 is secured in a manner such that it can rotate about a first fulcrum "O"; a tip 4, secured at one end to key 2 and moving integrally therewith, so that it can slide along a first axis "X" of said key 2, countered by an elastic means 41. Said elastic means 41 is, for example, a coil spring having a preset elastic constant "w". More in detail, tip 4 comprises a sliding portion 43 at its free end.

Said housing structure 3 is preferably a box-like structure in which the upper bases are open to allow inserting key 2 into the upper portion and securing a printed circuit board 5 in the lower portion, as clearly visible in the annexed drawings.

At the lower end, a closing element 37 is fitted after assembling the actuation mechanism in accordance with the invention.

Printed circuit board 5, located in the lower portion of said housing structure 3, comprises at least two push-buttons 51. A plurality of connection contacts 55 are secured to said printed circuit board 5 and are electrically connected to the electric circuits comprised in printed circuit board 5. Said connection contacts 55 come out at least partially from the closing element to allow connecting the switch to a further electric circuit, e.g. comprised in a vehicle or a boat.

Said housing structure 3 comprises, in its internal portion 3', a flared structure 31 comprising two inclined contact planes 311, e.g. specularly opposite with respect to a second axis "Z", preferably vertical, thus forming a first obtuse angle "α". Said tip 4 can slide on said inclined contact planes 311 along its stroke.

Said flared structure 31 is structurally secured to housing structure 3, e.g. to the inner walls of internal portion 3' of housing structure 3. Said flared structure 31 may be made integrally with housing structure 3, e.g. as one piece.

Said switch comprises at least one actuator 6 positioned in proximity to said flared structure 31, in particular alongside it.

Each actuator 6 comprises two contact portions 65, each one arranged alongside an inclined contact plane 311, upon which tip 4 acts along its stroke on said inclined contact planes 311, and two actuation portions 63, each one arranged on a push-button 51 and adapted to act upon respective push-button 51. Each push-button 51 comprises at least one silicone dome 511. Preferably, said silicone dome has an elastic constant which is greater than that of elastic means 41, e.g. a spring, comprised in key 2.

Said contact portions 65 are interposed between the two actuation portions 63. Preferably, said actuation portions 63 are located at the extremities of actuator 6 with respect to longitudinal axis "K" of the actuator itself. More preferably, said contact portions 65 and said actuation portions 63 are all aligned along said longitudinal axis "K".

Each actuation portion 63 of actuator 6 is located on top of a respective silicone dome 511.

Said actuator 6 is so arranged as to only weigh upon silicone domes 511. Said silicone domes 511 of respective push-buttons 51 are the only points on which actuator 6 rests.

Depending on the action directly exerted by tip 4 on one of said contact portions 65, the corresponding actuator 6 can rotate about one of two axes of rotation (T, T'), which are movable, distinct and specular with respect to said second vertical axis "Z", as a function of the direction of rotation of key 2.

Following the action directly exerted by tip 4 on one of said contact portions 65, each actuator 6 can rotate about one of two axes of rotations (T, T'), in particular as a function of the direction of rotation of key 2.

Each one of the two axes of rotation (T, T') is perpendicular to said axis "Z", preferably normal to the plane defined by the axes "Z" and "K". Preferably said axes of rotation (T, T') are at an actuation portion 63 of the actuator 6 itself, respectively. One axis of rotation (T, T'), depending on the action exerted on key 2, is located at actuation portion 63 opposite to actuation portion 63 that must act upon push-button 51. When the direction of rotation of key 2 is changed, axis of rotation (T, T') about which the actuator rotates will change as well, thereby changing the position thereof between the two actuation portions 63.

For the purposes of the present invention, the definition "movable axis of rotation" means that each one of said axes varies its own spatial position as a function of the rotation of key 2, thus not representing a fixed fulcrum point. No fulcra are used for rotating said actuator 6, since it only weighs upon silicone domes.

In the preferred embodiment, actuator 6 is monolithic, in particular it is made as one piece.

Figure 3:
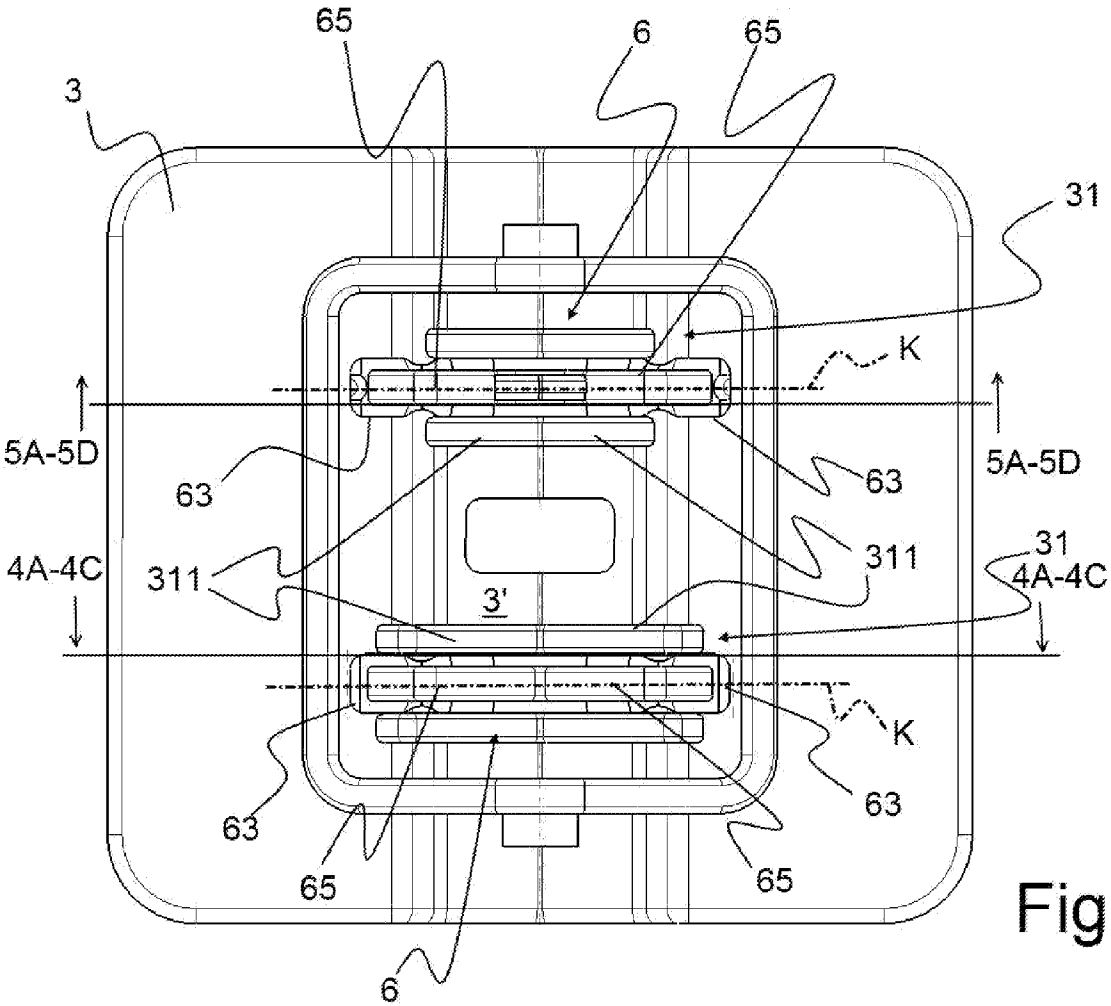
FIG. 3 is a top view of the switch according to the present invention, in particular of the housing structure thereof.

In the preferred embodiment, said contact portions 65 are interposed between the two actuation portions 63. Said actuation portions 63 are located at the extremities of actuator 6 with respect to longitudinal axis "K" of the actuator itself, as shown by way of example in FIG. 3.

In the preferred embodiment, each push-button 51 comprises, in addition to at least one silicone dome 511, at least one electric contact 512 adapted to close an electric circuit upon compression of dome 511, e.g. as the dome itself collapses. Preferably, both actuation portions 63 of actuator 6 are arranged on top of a respective silicone dome 511 of a respective push-button 51. More in detail, in a first embodiment of actuator 6 each contact portion 65 is an inclined plane preferably having a variable slope, and both portions have the same profile. Said contact portions 65 are specularly opposite with respect to said second axis "Z", thus forming a second flared structure that defines a second obtuse angle "ϕ", as clearly visible in FIG. 7C.

Such a configuration of contact portion 65 acts as a cam, through which a push-button 51 is operated as tip 4 intercepts the same portion 65.

Figure 7A:
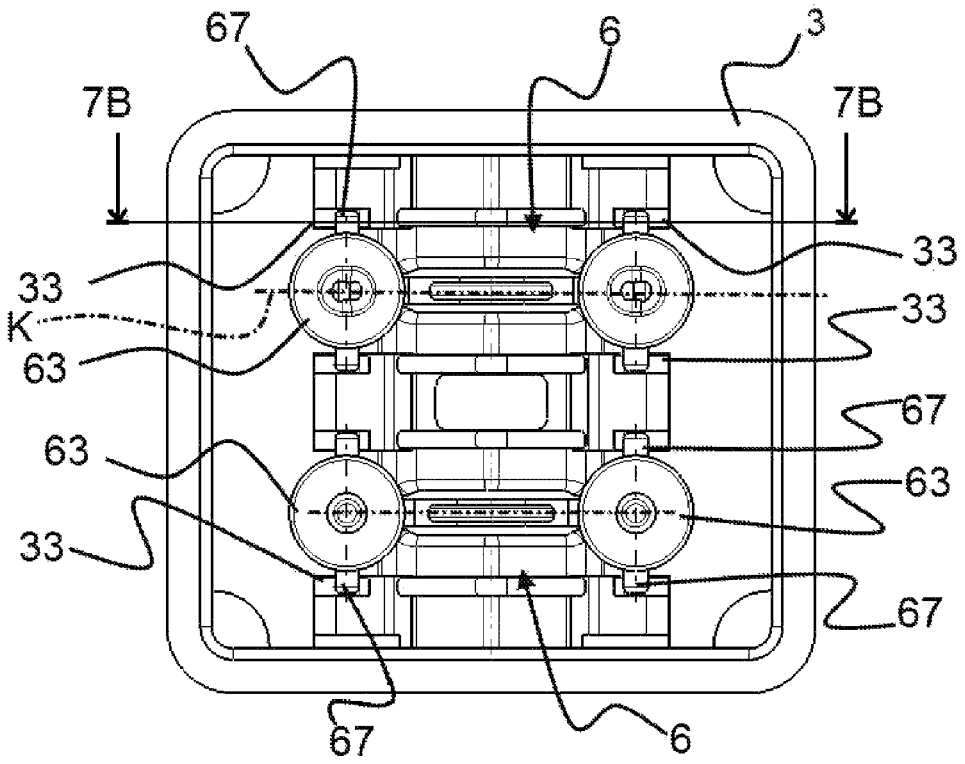
FIGS. 7A-7D show some sectional views of details of the different embodiments; in particular.
Figure 7B:
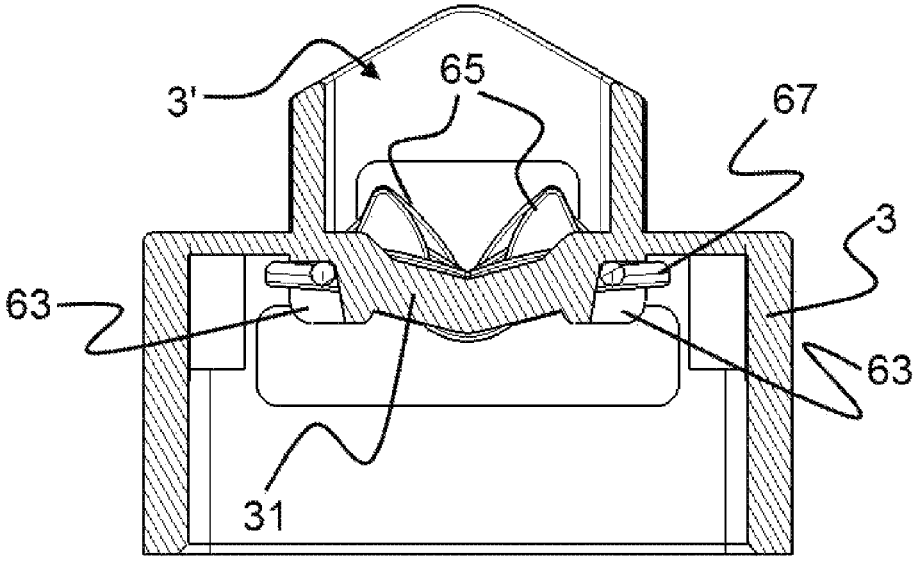
Figure 7C:
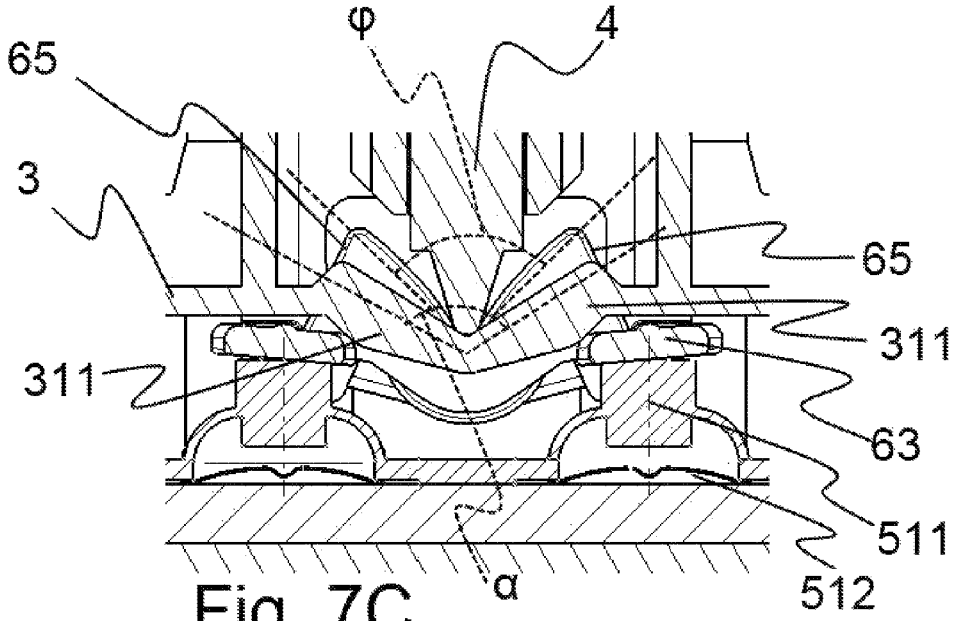
Figure 7D:
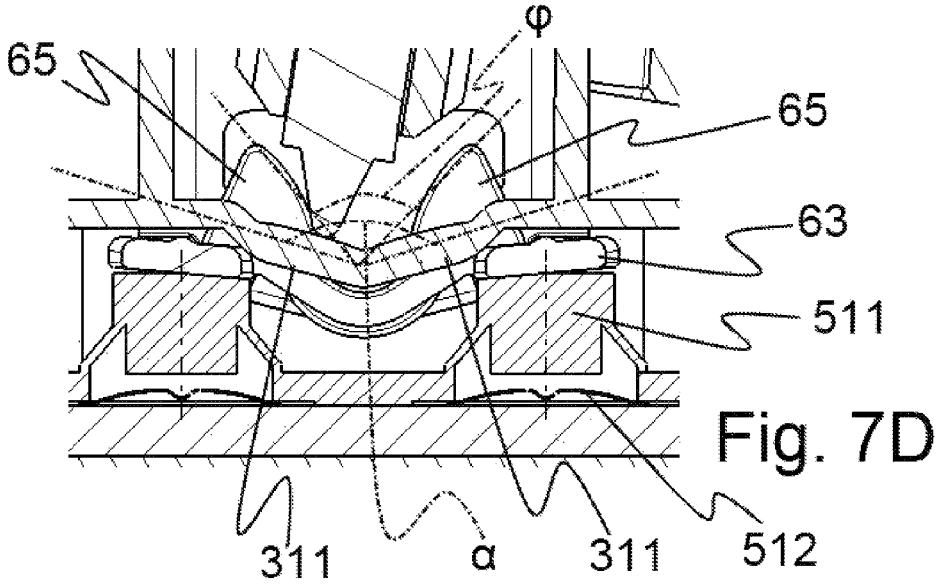

Said second obtuse angle "ϕ" is smaller than said first obtuse angle "α" formed by the inclined contact planes 311, as clearly shown in FIG. 7C.

Said actuation mechanism is assembled in such a way that said actuator 6 can rotate about the axes of rotation (T, T'), respectively rotating about a first axis of rotation T when key 2 is turned in one direction, e.g. counterclockwise or push, and rotating about a second axis of rotation T' when key 2 is turned in the opposite direction, e.g. clockwise or pull.

More in detail, as shown in the drawings, said axes of rotation (T, T') are located at actuation portions 63, in particular at that actuation portion which corresponds to push-button 51 opposite to push-button 51 that must be actuated upon rotation of key 2.

Said switch essentially takes three operating configurations:

- an idle configuration, wherein the first axis "X" of key 2 is substantially parallel to the second vertical axis "Z", and push-buttons 51 are both deactivated, e.g. open;
- a push configuration, wherein key 2 is inclined, preferably forwards, e.g. counterclockwise, so as to move tip 4 and activate a first push-button, e.g. the push-button on the left of axis "Z", as shown in the annexed drawings;
- a pull configuration, wherein key 2 is inclined in the direction opposite to that of the push configuration, preferably backwards, so as to move tip 4 and activate a second push-button, e.g. the push-button on the right of axis "Z", as shown in the annexed drawings;

The transition from the idle configuration to either one of the other configurations of the switch requires the intervention of the user, who applies a force onto key 2 and causes it to move about the first fulcrum "O". As it rotates about fulcrum "O", key 2 drags along tip 4 integral therewith.

When the user stops applying the force onto key 2, key 2 automatically returns into the idle configuration. This phenomenon is made possible by the action of elastic means 41 and by flared structure 31.

During the movement of tip 4, sliding portion 43 slides on an inclined contact plane 311, because tip 4 is countered by elastic means 41.

Along the stroke of tip 4, sliding portion 43 intercepts actuator 6 at a predetermined angle of rotation of key 2, thereby causing it to rotate about the corresponding axis of rotation T or T'.

In the illustrated embodiments, the axis of rotation (T, T') is located at actuation portions 63 lying on top of silicone dome 511, being in particular in contact therewith.

Actuator 6, intercepted through contact portion 65, in its turn exerts a force on the corresponding silicone dome 511 through actuation portion 63. The force applied onto actuator 6 by tip 4 through said actuation portion 63 is transmitted to the corresponding dome 511. In particular, actuated contact portion 65 transmits the force to actuation portion 63, which in its turn applies a compression force onto dome 511 of the corresponding push-button 51, thereby effecting the electric switching. In this situation, actuator 6 will rotate about the axis of rotation (T or T') located at actuation portion 63 opposite to actuation portion 63 that is compressing dome 511. In particular, actuator 6 rotates about an axis of rotation (T or T') located at actuation portion 63 associated with that contact portion 65 which is not affected by the action of tip 4.

According to the present invention, when key 2 is released the actuation mechanism automatically returns into the idle operating configuration.

When the switch is in the idle operating configuration, actuator 6 stops acting upon corresponding push-button 51, thus preventing any unintentional switching.

Silicone dome 511 has elastic properties that allow it to regain its initial shape after having been pressed and/or deformed.

Said silicone dome 511 is preferably formed in a silicone mat, e.g. arranged on printed circuit board 5. Preferably, all the silicone domes comprised in the switch according to the present invention are included in said silicone mat.

In different embodiments (not shown), said silicone dome may comprise said electric contact 512, which is integrated therewith. In the embodiment shown in the drawings, electric contacts 512 are comprised in a suitably shaped metal foil.

Each actuation portion 63 is adapted to be positioned at the respective silicone dome 511, particularly on top of it, preferably in contact therewith. Said actuation portion 63 is located at the axis of rotation (T, T') about which actuator 6 rotates when it is operated by tip 4 for actuating the opposite contact.

When assembling the switch according to the present invention, said actuator 6 is arranged in a manner such that, when the switch is in the idle operating configuration, it weighs upon silicone domes 511. Said silicone domes are arranged at a known distance "d" between centres dictated by the design specifications.

In the embodiment shown in the annexed drawings, housing structure 3 is structurally associated with said flared structure 31, which in turn comprises at least two equally inclined contact planes 311 opposite to each other, so as to create a symmetrical and specular flared structure.

The difference between said first obtuse angle "α" and said second obtuse angle "ϕ" defines a difference in the inclination between the first flared structure 31 of housing structure 3 and the second flared structure created by contact portions 65, as is clearly visible in the annexed drawings. The resulting inclination difference allows tip 4 to act upon actuator 6, which, while rotating about the appropriate axis of rotation T or T', will press against silicone dome 511 of associated push-button 51 through appropriate actuation portion 63.

Said key 2 comprises a guide 21 adapted to accommodate a portion of said tip 4, thus allowing tip 4 to slide along the first axis "X" of key 2 during the transitions between the various operating configurations, countered by at least one elastic means 41, e.g. a coil spring.

The stroke of tip 4 within guide 21 is delimited in one direction by the very structure of elastic means 41, and in the opposite direction by end-of-stroke elements formed in guide 21 and not depicted in detail.

Figure 4A:
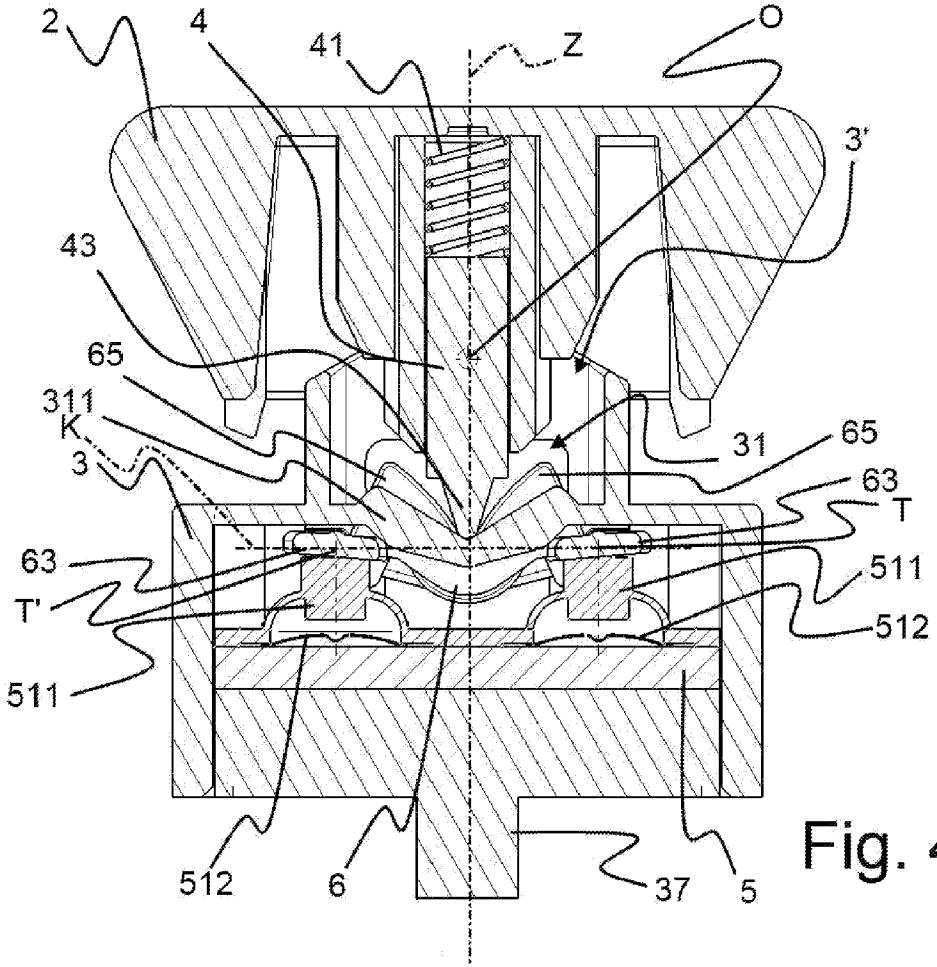
FIGS. 4A, 4B and 4C show a first embodiment of the switch of FIG. 1 in three configurations taken by the actuation mechanism at three consecutive instants.
Figure 4B:
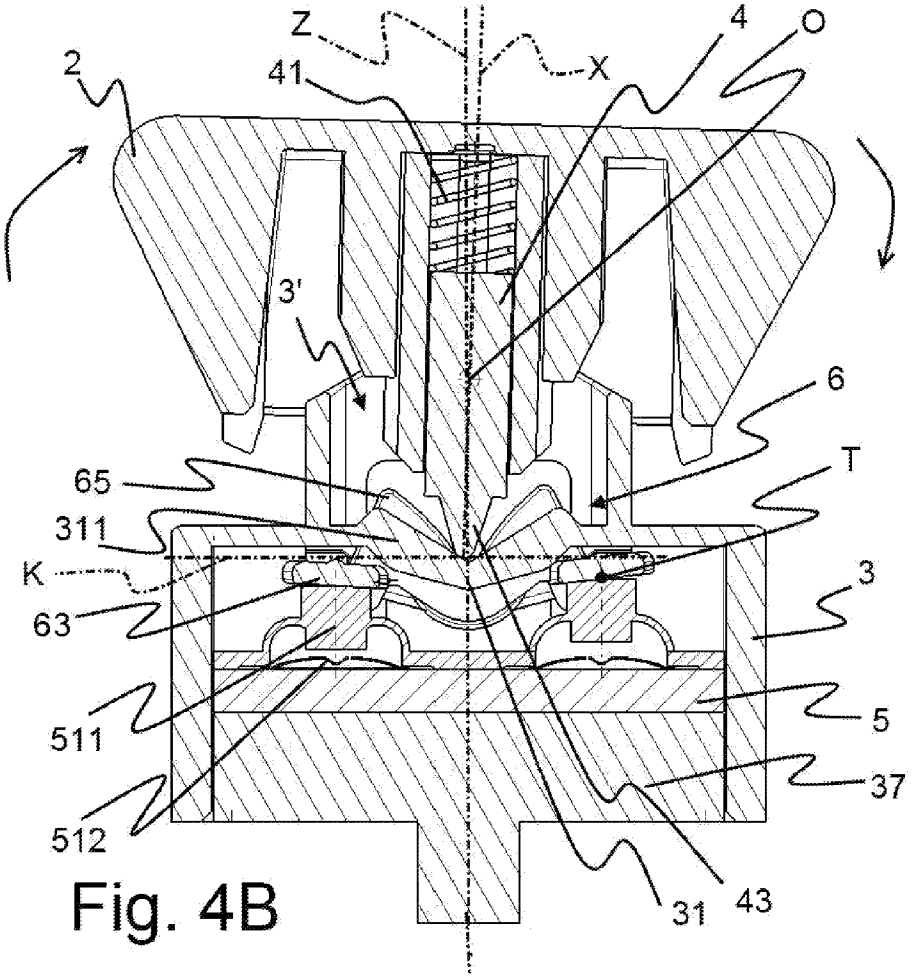
Figure 4C:
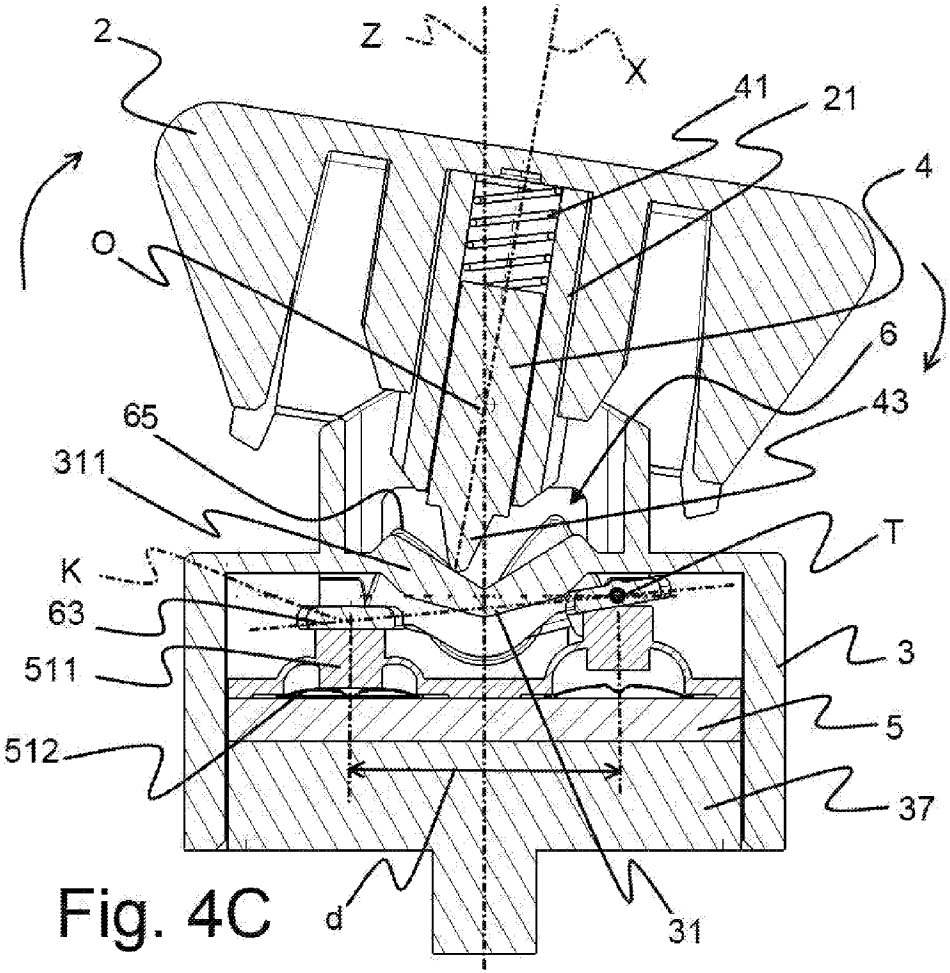

For the purposes of the present description, the following will describe in detail the behaviour of the components of the switch in accordance with the present invention, as shown by way of example in FIGS. 4A-4C.

In the idle operating configuration, the first axis "X" of key 2 is substantially parallel to axis "Z" of the switch because sliding portion 43 of tip 4 is positioned at the lowest point of flared structure 31 and is held in said position, thus preventing any vibrations or unintentional movements, by the action exerted by elastic means 41 on tip 4 itself, as shown in FIG. 4A. In said operating configuration, said actuator is so positioned that its longitudinal axis "K" is orthogonal to the axis "Z".

In the preferred embodiment, sliding portion 43 is held in said position also by contact portions 65 of actuator 6, which create a flared structure in which the inclined planes have a steeper slope, given by the smaller second obtuse angle "ϕ".

When key 2 is operated in order to get into the pull configuration, it rotates about fulcrum "O" and drags along tip 4, the motion of which is countered by elastic means 41, so that is starts sliding on inclined contact plane 311, as shown in FIG. 4B.

Along its stroke, tip 4 intercepts the corresponding contact portion 65 of actuator 6, which in the case illustrated herein is an inclined plane, thereby causing the actuator to rotate about the corresponding axis of rotation T; as it goes down, actuation portion 63, associated with contact portion 65 intercepted by the same actuator 6, operates corresponding push-button 51 by compressing silicone dome 511, thereby effecting the electric switching.

More in detail, in the pull configuration the tip slides on the inclined contact plane on the left of the second axis "Z", acting upon the corresponding contact portion 65. The action exerted by tip 4 on contact portion 65 causes actuator 6 to rotate about the axis of rotation T located at actuation portion 63 on the right of the second axis "Z". Such rotation lowers the opposite actuation portion 63, i.e. the one on the left, associated with intercepted contact portion 65, thus operating corresponding push-button 51, and in particular compressing silicone dome 511. When the left-hand silicone dome is compressed, the right-hand silicone dome will not collapse because the compression force acting upon that dome will not be sufficient to cause it to collapse. These features are clearly visible in FIG. 4C. In the push or pull operating configurations, actuator 6 of the switch according to the present invention is inclined, as opposed to perpendicular, relative to vertical axis "Z".

When the user stops operating key 2, tip 4 slides in the opposite direction through the effect of elastic means 41, thus returning into the idle operating condition and releasing contact portion 65 of actuator 6, so that actuation portion 63 will no longer act upon the corresponding dome 511.

In its turn, actuator 6 is returned in position by dome 511, which, thanks to its elastic properties, rises again to bring actuator 6 back in position, in particular with axis "K" perpendicular to the second axis "Z".

When key 2 is operated in order to get into the push configuration, the sequence is repeated in a specular manner, involving the right-hand contact portion 65 and rotating about the second axis of rotation T' located at actuation portion 63 on the left of the second axis "Z".

If the user holds the switch in the push or pull configuration, tip 4 will continue to act upon the corresponding contact portion 65 of actuator 6, through the sliding portion 43, without generating any spurious switching of push-button 51. In particular, when key 2 is held pressed in the push or pull configuration, there will be no switching of other push-button 51 which bears actuation portion 63 about which actuator 6 is rotated, and which is associated with contact portion 65 not being intercepted by tip 4.

In the embodiment illustrated in FIGS. 5A-5D, said contact portions 65 have such a shape that ensures a predetermined trend of the force/displacement function perceived by the user, in particular that ensures a force/displacement function in which there is a balance point "e" between the resistance force of dome 511 and the force applied onto the same dome by said tip 4, on said actuator 6, and accumulated by said elastic means 41, beyond which point, without any further movement of key 2, there is a substantially instantaneous force reduction which translates into the switching of the corresponding push-button 51, obtained by releasing the energy accumulated by elastic means 41, and particularly into the collapse of silicone dome 511 that acts upon contact 512, thereby effecting the switching.

Figure 6:
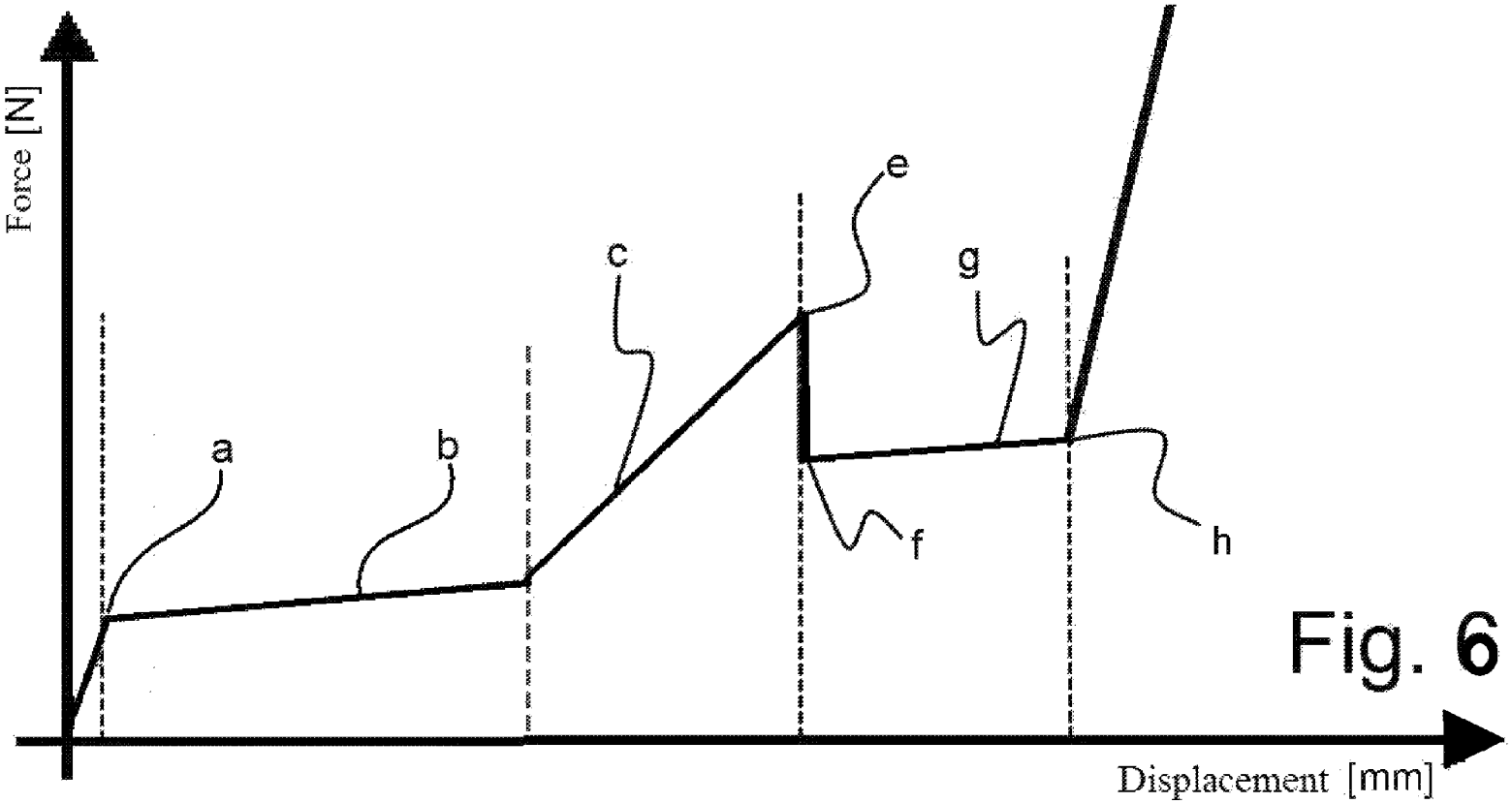
FIG. 6 shows the force/displacement graph obtained by means of the actuation mechanism shown in FIGS. 5A-5D.

This function is described in the graph shown in FIG. 6.

Figure 5A:
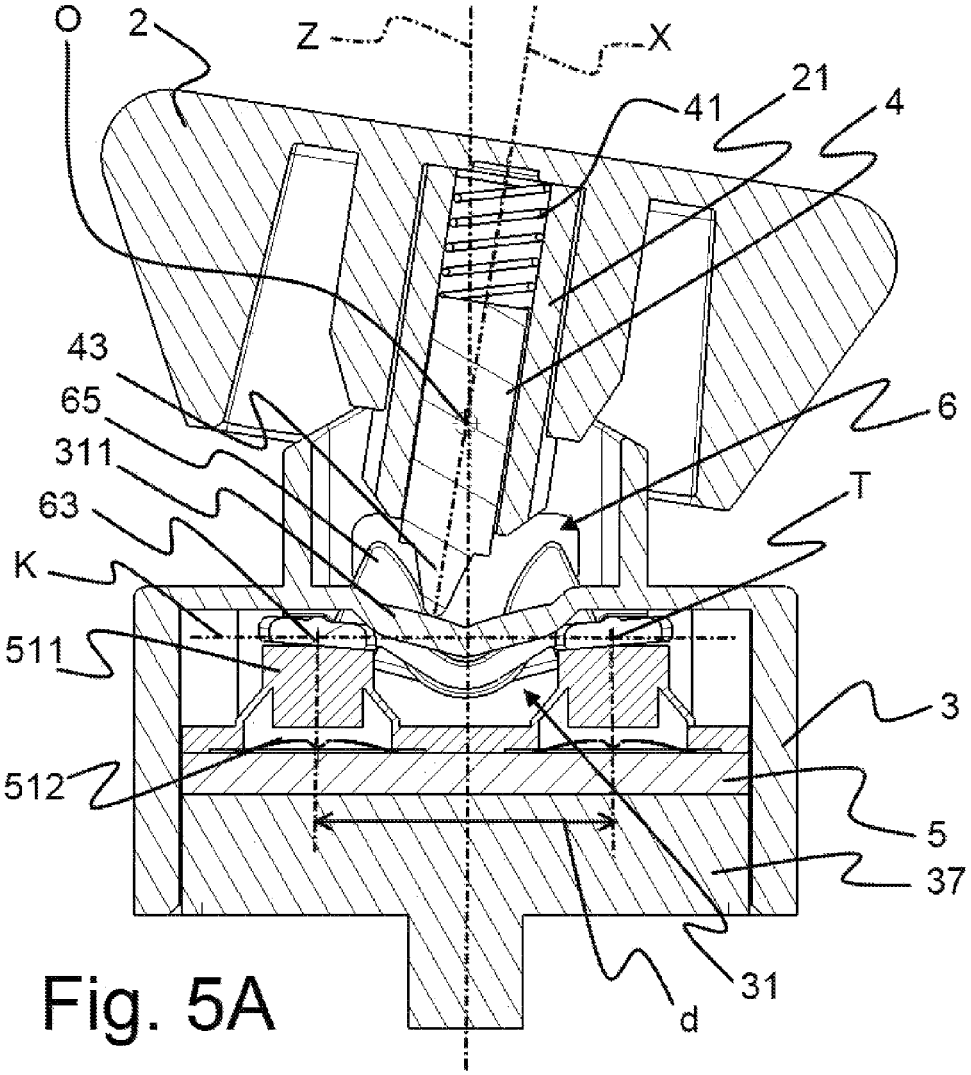
FIGS. 5A, 5B, 5C and 5D show a second embodiment of the switch of FIG. 1 in four configurations taken by the actuation mechanism at four consecutive instants.
Figure 5B:
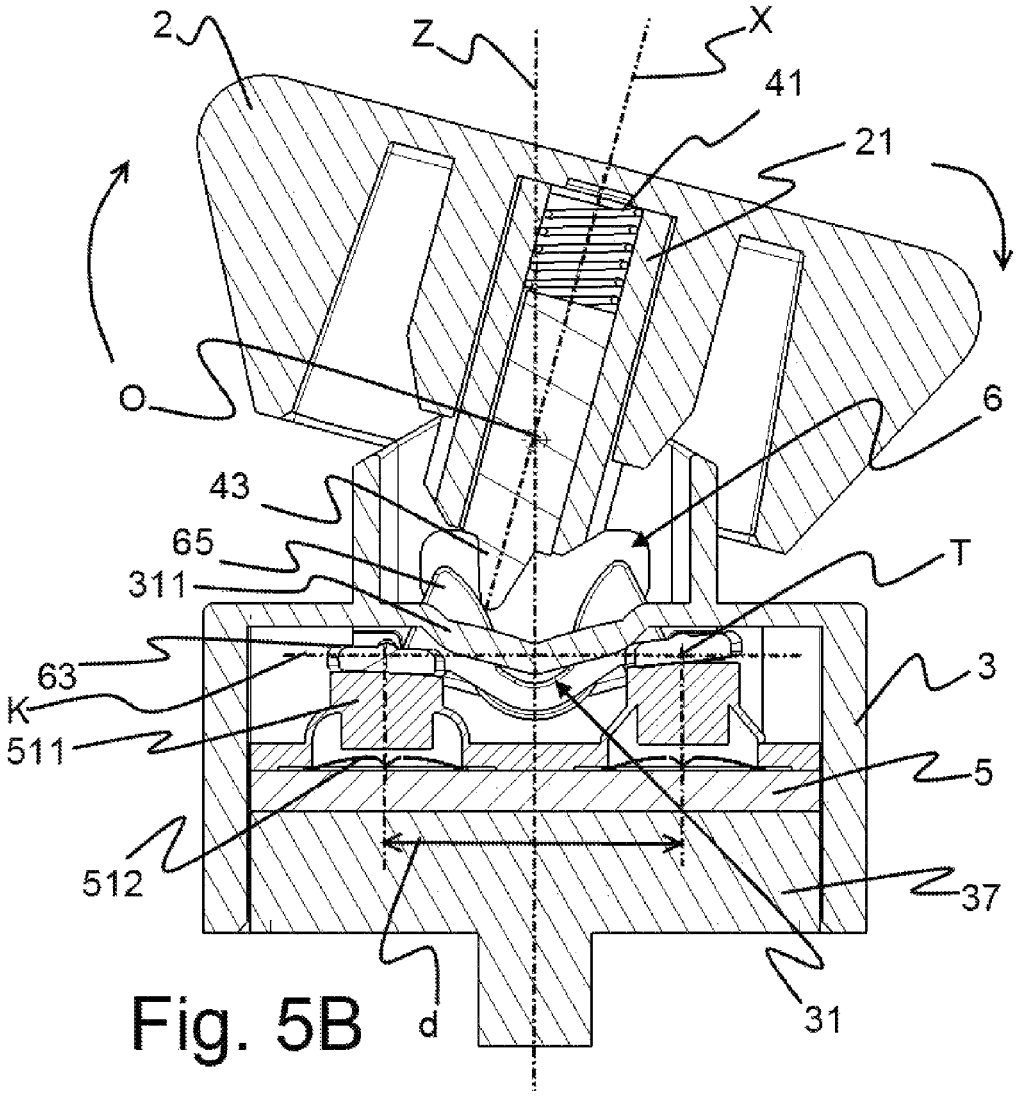

In the first section "a" of the graph, corresponding to the phase preceding the configuration shown in FIG. 5A, tip 4 is sliding along inclined contact planes 311 until it reaches point "b", where it begins intercepting contact portion 65. As it reaches point "b", the mechanism enters an operating configuration, e.g. as shown in FIG. 5B, wherein tip 4, instead of continuing its stroke along inclined plane 311, compresses elastic means 41, which has a predetermined elastic constant "w" smaller than the elastic constant of the silicone domes, while sliding on the same contact portion 65. As key 2 is rotated, elastic means 41 will keep compressing, corresponding to section "c" of the graph, up to point "e" in the graph.

Figure 5C:
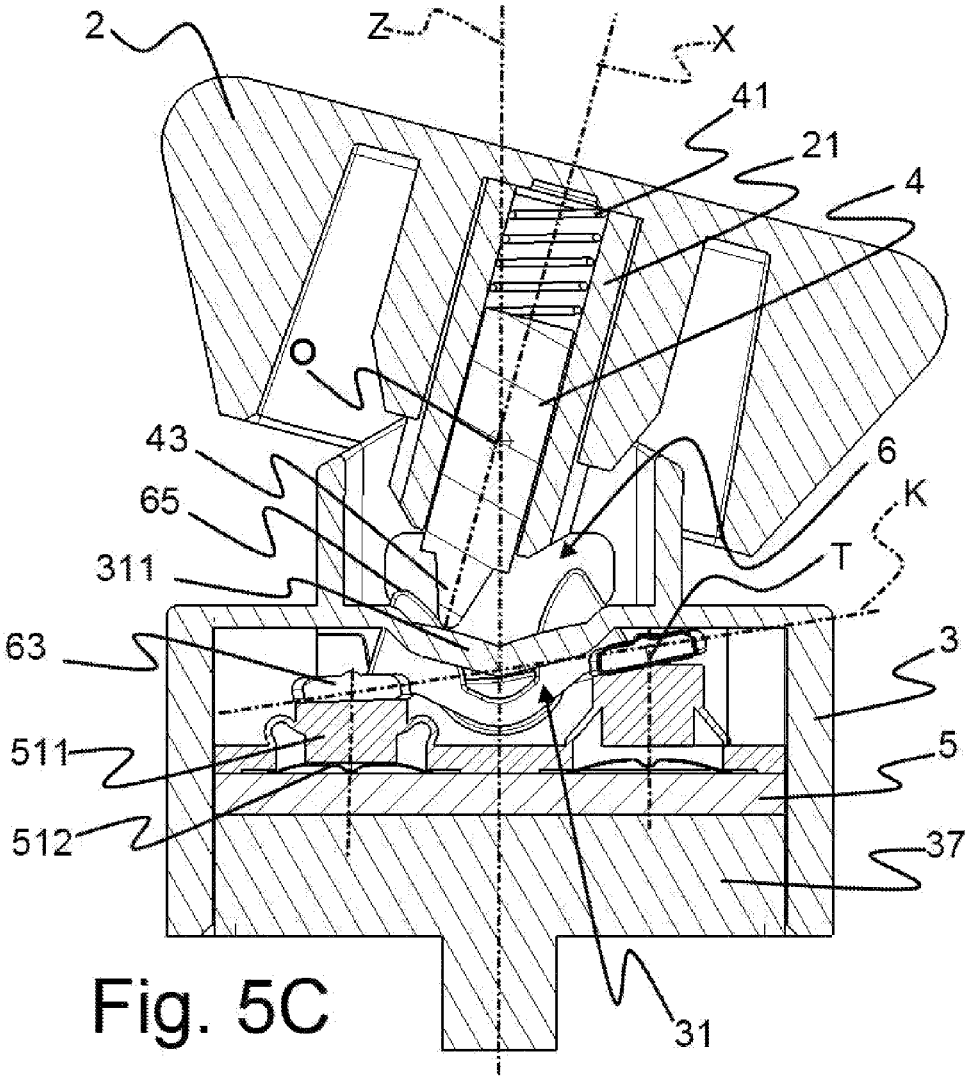
Figure 5D:
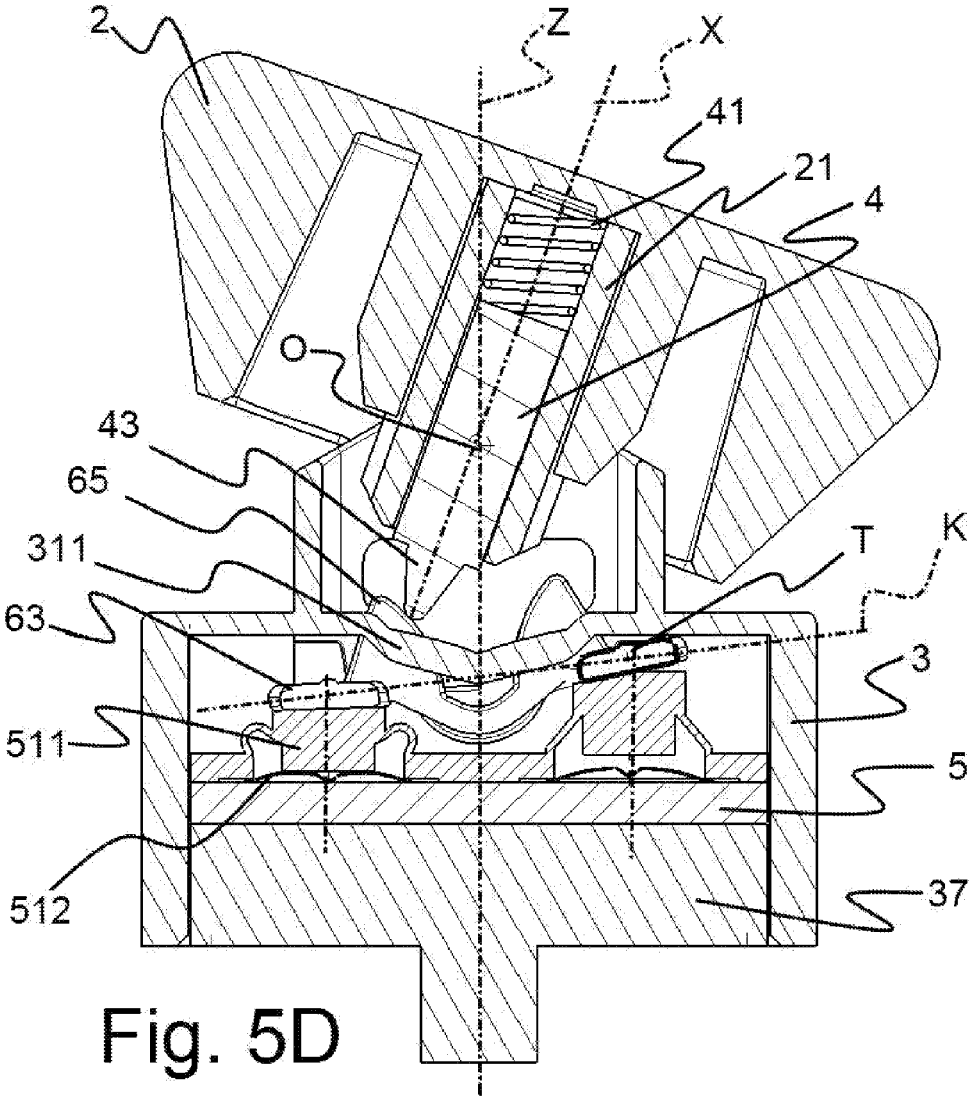

Along section "c" of the graph, the shape of contact structure 65 on which tip 4 is sliding causes elastic means 41 to compress, thus accumulating energy. As point "e" is passed, with no further movement of key 2 there is a substantially instantaneous force reduction that translates into the switching of push-button 51, particularly the collapse of dome 511. This configuration is visible in FIG. 5C. FIGS. 5B and 5C substantially correspond to the same movement of key 2, but refer to two consecutive time instants, before and after the force reduction visible in the graph of FIG. 6. After passing point "e" in the graph, the energy accumulated by elastic means 41, e.g. a spring, will exceed the resistance induced by silicone dome 511.

Point "f" corresponds to the point where the tip starts again to slide along contact portion 65, covering graph section "g". Point "h" corresponds to the end of the rotation stroke of key 2.

Such a result in terms of desired feeling and displacement graph is attained by appropriately designing the shape of the respective contact portions 65, particularly by creating:

- a first portion in which the contact portion has such a profile that does not affect the actuation of push-button 51, up to a predetermined angle of rotation of key 2.
- a second portion having a horizontally asymptotically curved profile, substantially with a humpback shape, as shown by way of example in the drawings.

Said first portion may be created through a flaring in which contact portion 65 cannot be intercepted by the tip, or the contact portion may have a slope substantially similar to the slope of the inclined contact planes.

Furthermore, elastic constant "w" of elastic means 41 has a preset value that allows it to compress, along sections "c" and "g" in the graph of FIG. 6, so as to avoid to involuntarily trigger the rotation of actuator 6 at undesired angles of rotation.

In addition, the portion with a curved profile of contact portion 65 provides an arm-multiplying effect, thus ensuring a substantially instantaneous transition between points "e" and "f" in the graph of FIG. 6.

The term "substantially instantaneous" refers to the fact that the force reduction represented in the graph and the transition between the configurations of FIGS. 5B and 5C occur in a very short time, such as a few milliseconds, preferably less than 1 millisecond.

Every movement of key 2 corresponds to the movement of only one actuation portion 63 of actuator 6 and of associated push-button 51.

The present solution almost completely eliminates all push-button activation criticalities.

As mentioned above, the return movement of key 2 is ensured by elastic means 41, while at the same time actuator 6 returns to the initial condition and stops acting upon push-button 51, so that dome 511 can rise again.

In general, as shown in FIGS. 7A and 7B, in order to prevent any longitudinal movement of actuator 6, e.g. along said longitudinal axis "K", while operating key 2, at least one retaining element 67 is included which is adapted to be inserted into a suitable housing 33 formed, for example, in internal portion 3' of housing structure 3. The arrangement and location of said retaining element 67 is apparent from FIGS. 7A and 7B; in particular, said retaining element 67 is, for example, a protrusion comprised in actuator 6 and located near actuation portion 63.

Said retaining element 67 will act against the walls of the respective housing 33 when the nearby actuation portion 63 acts as an axis of rotation (T or T') for actuator 6, for the purpose of preventing a longitudinal movement of the same actuator 6, e.g. excessive movement towards contact element 65 being intercepted by tip 4.

Such a solution ensures proper switching of the contacts of the switches even though the design specifications require a reduced angle of rotation of key 2 and a shorter distance between push-buttons 51. Furthermore, this solution does not require, in order to ensure that the device will operate correctly, an increased number of parts or components, thus simplifying the assembly process.

REFERENCE NUMERALS

Key 2
Guide 21
Housing structure 3
Flared structure 31
Internal portion 3'
Inclined contact planes 311
Housings 33
Closing element 37
Tip 4
Elastic means 41
Sliding portion 43
Printed circuit board 5
Push-button 51
Silicone dome 511
Electric contact 512
Connection contacts 55
Actuator 6
Actuation portion 63
Contact portion 65
Retaining element 67
First fulcrum "O"
First axis "X"
Second axis "Z"
Longitudinal axis "K"
First axis of rotation "T"

Second axis of rotation "T'"
First obtuse angle "α"
Second obtuse angle "φ"
Distance "d"

The invention claimed is:

1. A control switch comprising:

a key, a housing structure, in an upper portion of which said key is secured in a manner such that said key is rotatable about a first fulcrum;

a tip, secured at one end to the key and moving integrally with the key, so as to slide along a first axis of said key, countered by an elastic element;

a printed circuit board, comprising at least two push-buttons, arranged in a lower portion of said housing structure; each push-button comprising at least one silicone dome and at least one electrical contact adapted to close an electrical circuit upon compression of said silicone dome;

said housing structure comprising in an internal portion, a flared structure comprising two inclined contact planes symmetrically aligned with respect to a vertical axis and forming a first obtuse angle, on which said tip is slidable;

said flared structure is structurally secured to the housing structure;

at least one actuator positioned alongside said flared structure to be intercepted by the tip and causing electrical change of at least one push-button of said at least two push-buttons;

each actuator is monolithic and comprises two contact portions, each of the contact portions located alongside an inclined contact plane, upon which the tip acts, and two actuation portions, each of the actuation portions located in proximity to a push-button and for acting upon a respective push-button exercising a force on a corresponding silicone dome;

said contact portions are interposed between the two actuation portions;

each actuation portion of the actuator lies on top of a respective silicone dome, so that said actuator only weighs upon the respective silicone dome; and wherein, depending on an action directly exerted by the tip on one of said contact portions, a corresponding actuator can rotate about one of two axes of rotation;

each one of said two axes of rotation is respectively located on an actuation portion of the actuator;

depending on a direction of rotation of the key, an axis of rotation of said two axes of rotation is located at an actuation portion opposite to an actuation portion that acts upon at least one of said at least two push-buttons.

2. A control switch according to claim 1, wherein each contact portion of the two contact portions of the actuator is an inclined plane; said contact portions are symmetrical with respect to said vertical axis, thus forming a second flared structure with a second obtuse angle.

3. A control switch according to claim 1, wherein said actuation portions are located at extremities of the actuator with respect to a longitudinal axis of the actuator.

4. A control switch according to claim 1, comprising at least one retaining element insertable into a housing in the internal portion of the housing structure for preventing the actuator from moving longitudinally along said longitudinal axis.

5. A control switch according to claim 4, wherein said retaining element is a protrusion comprised in the actuator.

* * * * *